US010662891B2

(12) United States Patent
Li et al.

(10) Patent No.: US 10,662,891 B2
(45) Date of Patent: May 26, 2020

(54) LASER REMELTING TO ENHANCE CYLINDER BORE MECHANICAL PROPERTIES

(71) Applicant: GM GLOBAL TECHNOLOGY OPERATIONS LLC, Detroit, MI (US)

(72) Inventors: Huaxin Li, Rochester Hills, MI (US); Daniel J Wilson, Linden, MI (US); Martin S Kramer, Clarkston, MI (US); Dale A Gerard, Bloomfield Hills, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 81 days.

(21) Appl. No.: 15/478,741

(22) Filed: Apr. 4, 2017

(65) Prior Publication Data

US 2018/0283310 A1 Oct. 4, 2018

(51) Int. Cl.
*F02F 1/00* (2006.01)
*C23C 4/18* (2006.01)
(Continued)

(52) U.S. Cl.
CPC ..... *F02F 1/004* (2013.01); *C23C 4/18* (2013.01); *C23C 28/021* (2013.01); *F02F 1/18* (2013.01); *F02F 2001/008* (2013.01)

(58) Field of Classification Search
CPC ..... F02D 19/0615; F02D 19/061; F02D 19/0647; F02D 19/0628; F02D 19/0692;
(Continued)

(56) References Cited

U.S. PATENT DOCUMENTS 5,080,056 A * 1/1992 Kramer ..... F02F 7/0007 123/193.4
5,429,173 A * 7/1995 Wang ..... B22D 19/08 164/100

(Continued)

FOREIGN PATENT DOCUMENTS

ES 2284355 A1 * 11/2007

OTHER PUBLICATIONS

US Application Filing Date: Nov. 4, 2016; U.S. Appl. No. 15/343,286; Applicant: GM Global Technology Operations LLC; Title: Strengthening Layer Attached to Cylinder Bore.

(Continued)

*Primary Examiner* — Joseph J Dallo
*Assistant Examiner* — Kurt Philip Liethen

(57) ABSTRACT

An engine block, an automotive structure, and a method of coating an inner surface of an engine cylinder bore of an engine cylinder are provided. The method includes providing an inner bore substrate defining an inner surface of the engine cylinder bore, the inner bore substrate being formed of a first material. The method further includes disposing a thermal spray coating onto the inner surface of the engine cylinder bore. The thermal spray coating is formed of a second material that is different than the first material. The method also includes melting at least a portion of the thermal spray coating with a laser after performing the step of disposing the thermal spray coating onto the inner surface of the engine cylinder bore. The automotive structure and the engine block have a substrate covered by a thermal spray coating and laser remelted sections anchoring the coating to the substrate.

7 Claims, 3 Drawing Sheets

(51) Int. Cl.
*C23C 28/02* (2006.01)
*F02F 1/18* (2006.01)

(58) Field of Classification Search
CPC ..... F02D 41/0025; F02D 41/0027; F02D 2250/21; F02D 41/1497; Y02T 10/36; F02B 43/00
See application file for complete search history.

(56) References Cited

U.S. PATENT DOCUMENTS 9,316,341 B2 * 4/2016 Kusinski ..... F16L 58/08
9,488,126 B2 * 11/2016 Bischofberger ..... C23C 4/02
2002/0025386 A1 * 2/2002 Heinemann ..... C23C 4/02 427/446
2003/0152698 A1 * 8/2003 Smith ..... C23C 4/08 427/236
2004/0156724 A1 * 8/2004 Torigoe ..... C23C 4/18 416/241 R
2006/0121292 A1 * 6/2006 Weaver ..... C23C 4/02 428/457
2009/0017260 A1 * 1/2009 Kulkarni ..... C23C 4/18 428/161
2010/0028711 A1 * 2/2010 Helmick ..... C23C 4/18 428/623
2010/0279022 A1 * 11/2010 Ajdelsztajn ..... C23C 4/18 427/451
2014/0065361 A1 * 3/2014 Rosenzweig ..... C23C 4/00 428/141
2016/0356242 A1 12/2016 Petrus et al.
2017/0342576 A1 * 11/2017 McWaid ..... C25B 9/045

OTHER PUBLICATIONS

US Application Filing date Jun. 16, 2016; U.S. Appl. No. 15/184,699 , Applicant: GM Global Technology Operations LLC; Title: Surface Texture Providing Improved Thermal Spray Adhesion.
US Application Filing date Aug. 10, 2016; U.S. Appl. No. 15/233,254, Applicant: GM Global Technology Operations LLC; Title: Improved Adhesion of Thermal Spray Using Compression Technique.
US Application Filing date Jun. 29, 2015; U.S. Appl. No. 14/753,152, Applicant: GM Global Technology Dperations LLC; Title: Phosphating or Anodizing for Improved Bonding of Thermal Spray Coating on Engine Cylinder Bores.

* cited by examiner

LASER REMELTING TO ENHANCE CYLINDER BORE MECHANICAL PROPERTIES

FIELD

The present disclosure relates to engine blocks and automotive components having a thermal spray coating deposited on a substrate and methods for coating the inner surface substrates of engine cylinder bores.

INTRODUCTION

Thermal spraying is a coating process that applies material heated and typically melted by combustion or an electrical plasma or arc to a substrate, such as a cylinder bore of an engine. The process is capable of rapidly applying a relatively thick coating over a large area relative to other coating processes such as electroplating, sputtering and physical and vapor deposition.

Typically, the most significant factor affecting the ruggedness and durability of a thermal spray coating is the strength of the bond between the thermal spray coating and the surface. A poor bond may allow the thermal spray coating to crack or peel off, sometimes in relatively large pieces, long before the thermal sprayed material has actually worn away, whereas a strong bond renders the thermal spray coating an integral and inseparable component of the underlying surface. Achieving a good bond between the thermal spray coating and the inner surface of the bore is one of the challenges that manufacturers face.

In addition, even if an acceptable bond is initially achieved, the thermal spray coating needs to be able to remain in workable condition over many engine cycles. However, the base material of the engine block and inner surfaces of the cylinder bores themselves may flex over time, particularly at the open ends of the cylinders and under high temperature conditions. Under such conditions, the thermal spray coating may crack or peel off, which may also decrease the life of the thermal spray coating on the cylinders.

SUMMARY

The present disclosure provides an automotive structure, such as a cylinder bore of an engine block, having thermal spray coating deposited on a substrate and a plurality of laser remelted sections providing anchoring and strength between the substrate and the thermal spray coating. An associated method for applying the thermal spray coating and laser remelted sections is also disclosed. An interface material may be disposed between the substrate and the thermal spray coating to provide improved adherence between the laser remelted sections and the substrate.

In one form, which may be combined with or separate from the other forms disclosed herein, a method of creating an engine cylinder bore of an automotive engine is provided. The method includes providing an inner bore substrate defining an inner surface of the engine cylinder bore, where the inner bore substrate is formed of a first material. The method further includes disposing a thermal spray coating onto the inner surface of the engine cylinder bore, such that a substantial entirety of a piston travel path on the inner surface is covered by the thermal spray coating. The thermal spray coating is formed of a second material that is different than the first material. The method also includes melting at least a portion of the thermal spray coating with a laser after performing the step of disposing the thermal spray coating onto the inner surface of the engine cylinder bore.

In another form, which may be combined with or separate from the other forms disclosed herein, an engine block is provided that includes a base block comprising a plurality of cylinders, each cylinder defining a cylinder bore having an inner surface. A thermal spray coating is disposed on the inner surface of each cylinder bore, such that a substantial entirety of a piston travel path on each inner surface is covered by the thermal spray coating. The thermal spray coating has a plurality of laser remelted sections providing anchoring of the thermal spray coating to the inner surface of each cylinder bore.

In yet another form, which may be combined with or separate from the other forms disclosed herein, a structure for use in automotive applications is provided. The structure includes a metal substrate substantially comprised of a first material and a thermal spray coating disposed on the metal substrate. The thermal spray coating is substantially comprised of a second material that is different than the first material. The thermal spray coating has a plurality of laser remelted sections providing anchoring of the thermal spray coating to the metal substrate.

Additional features may also be provided, including but not limited to the following: wherein the step of melting at least a portion of the thermal spray coating with the laser includes melting multiple sections of the thermal spray coating to form a plurality of laser remelted sections, while allowing at least a portion of the thermal spray coating to remain unmelted by the laser; each laser remelted section forming a diffusion bond between the thermal spray coating and the substrate; each laser remelted section having a heat affected zone that forms a bond with the substrate; the base block being formed of a first material and the thermal spray coating being formed of a second material that is different than the first material; an interface material disposed onto the substrate between the substrate and the thermal spray coating; the interface material being formed of a third material that is different than each of the first and second materials; the third material having a lower melting point than each of the first and second materials; the first material being substantially comprised of aluminum; the second material being substantially comprised of steel; the third material being substantial comprised of at least one of the following: zinc, copper, nickel, and tin; and wherein each laser remelted section is disposed adjacent to a portion of the thermal spray coating that remains unmelted by laser.

Further aspects, advantages and areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way. In addition, the drawings herein are schematic in nature and are not necessarily drawn to scale or representative of the distances or relationships between the elements shown.

Figure 1:
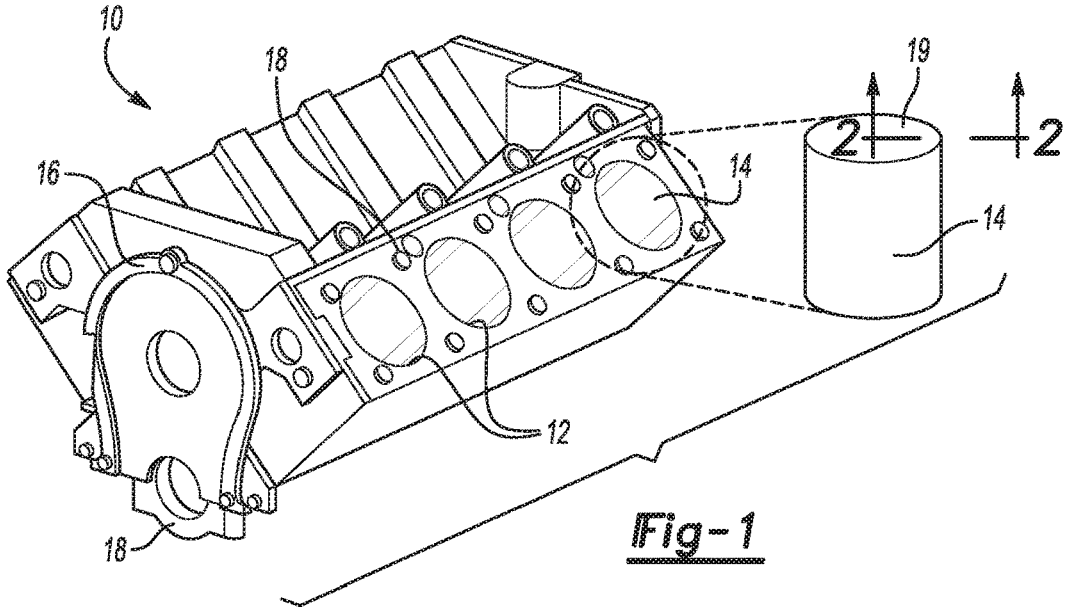
FIG. 1 is a schematic perspective view of an internal combustion engine block having a plurality of cylinder bores, with an enlarged view of a cylinder bore wall substrate of a cylinder bore, in accordance with the principles of the present disclosure.
Figure 6:
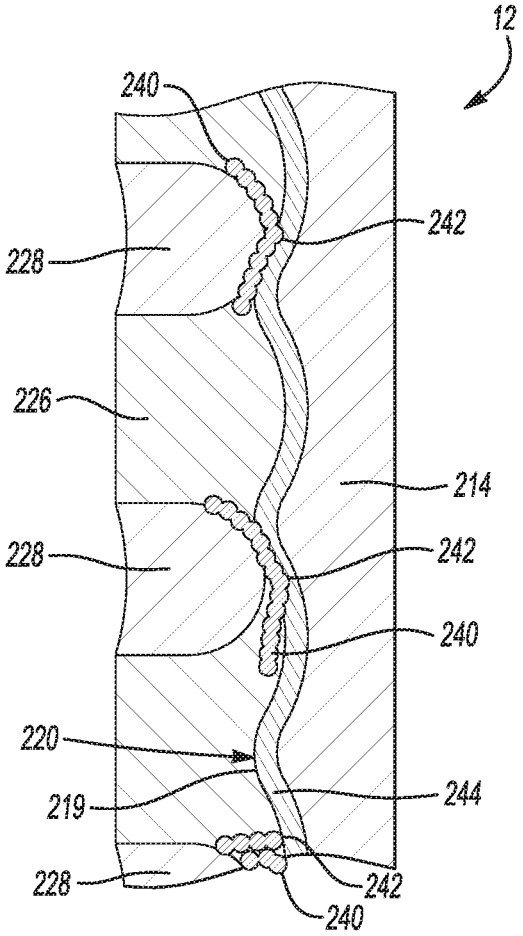
Figure 7:
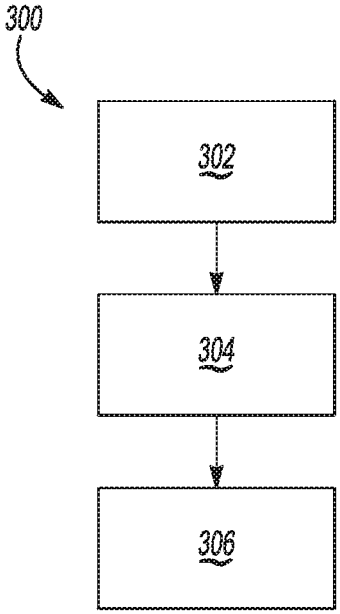

FIG. 6 is an enlarged schematic cross-sectional view of yet another variation of a portion of the cylinder bore wall substrate shown in FIG. 1, which could also be understood to be taken along line 2-2 of FIG. 1, according to the principles of the present disclosure; and FIG. 7 is a block diagram illustrating a method of creating an engine cylinder bore of an automotive engine is provided, according to the principles of the present disclosure.

DETAILED DESCRIPTION

The following description is merely exemplary in nature and is not intended to limit the present disclosure, application, or uses.

With reference to FIG. 1, an internal combustion engine block is illustrated and generally designated by the reference number 10. The engine block 10 typically includes a plurality of cylinders 12 having interior cylinder bores 14, numerous flanges 16 and openings 18 for threaded fasteners, and other features for receiving and securing components such as cylinder heads, shafts, manifolds and covers (all not illustrated).

The right side of FIG. 1 shows an enlarged representation of a cylinder bore 14. The cylinder bore 14 includes a substrate that may be an inner surface of the aluminum engine block 10 or a surface of a sleeve, such as an iron sleeve, that has been installed in the cylinder bore 14. Thus, the cylinder bore 14 has an inner surface substrate or wall 19. In either case, the surface finish of the inner surface substrate 19 of the cylinder bore 14 may be a machined profile which is mechanically roughened or activated, if desired.

It will be appreciated that although illustrated in connection with the cylinder bore 14 of an internal combustion engine 10, with which it is especially beneficial, the present disclosure provides benefits and is equally and readily utilized with other cylindrical surfaces of automotive structures, such as the walls of hydraulic cylinders and flat surfaces such as planar bearings which are exposed to sliding, frictional forces.

Figure 2:
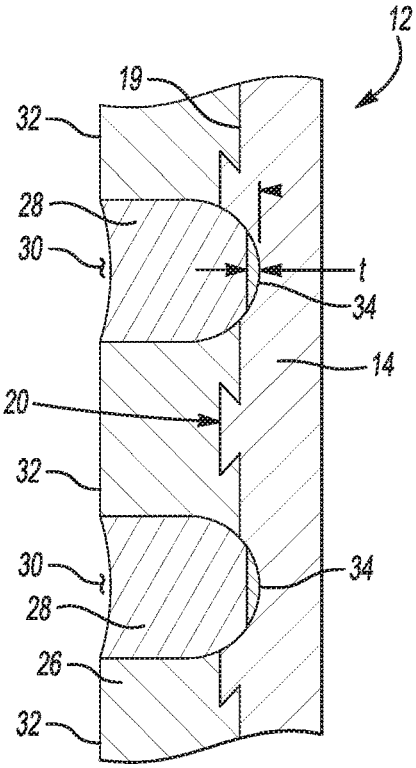
FIG. 2 is an enlarged schematic cross-sectional view of a portion of the cylinder bore wall substrate shown in FIG. 1, taken along line 2-2 of FIG. 1, according to the principles of the present disclosure.

Referring now to FIG. 2, an enlarged cross-section of a portion of the cylinder bore 14 schematically illustrates the surface texture 20 of the activated surface of the inner surface substrate 19 of the cylinder bore 14. In this case, a dovetailed surface texture 20 is illustrated, though it should be understood that other surface texturing could be used, or the surface texturing could be omitted, without falling beyond the spirit and scope of the present disclosure. In some examples, the surface texture 20 could have a depth of about 50 to about 250 μm, by way of example.

Figure 3A:
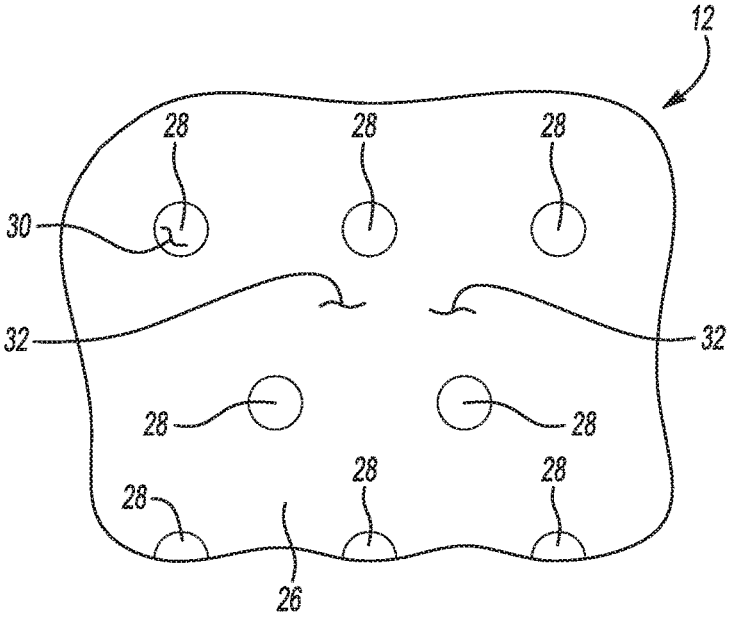
FIG. 3A is a side view from within one of the cylinder bores shown in FIG. 1, showing the cylinder bore wall substrate, in accordance with the principles of the present disclosure.

Referring to FIGS. 2 and 3A, a thermal spray coating 26 is formed on the inner surface substrate 19 of each cylinder bore 14, wherein the thermal spray coating 26 is adhered to the inner surface substrate 19 (including to the surface profile 20), in this variation. FIG. 3A is a view of the inside of the cylinder bore 14 on the surface of the thermal spray coating 26. Typically, the thermal spray coating 26, after honing, may be on the order of about 150 μm and is typically within the range of from about 130 μm to about 175 μm. Some applications may require thermal spray coatings 26 having greater or lesser thicknesses, however. The thermal spray coating 26 may formed of a steel or a steel alloy, another metal or alloy, a ceramic, or any other thermal spray material suited for the service conditions of the product and may be applied by any one of the numerous thermal spray processes such as plasma, detonation, wire arc, flame, or HVOF suited to the substrate and material applied.

A plurality of laser remelted sections 28 are formed in the thermal spray coating 26 by a laser. The laser remelted sections 28 are formed after the thermal spray coating 26 has been applied to the inner surface substrate 19. The laser remelted sections 28 provide for improved anchoring of the thermal spray coating 26 to the inner surface substrate 19 of each cylinder bore 14. The laser remelted sections 28 may increase axial and hoop strength in the thermal spray coating 26, as well as wear resistance. In addition, beneficial oil retention pockets or channels 30 may be formed on the surface of the thermal spray coating 26 by virtue of the laser remelted sections 28.

The laser remelted sections 28 are illustrated as spot laser remelted sections, being circular and having a staggered pattern (see FIG. 3A), however, it should be understood that the laser remelted sections 28 could have any pattern or could be formed over the entirety of the thermal spray coating 26. For example, the laser remelted sections 28 could be made with a single line that is formed by moving a laser beam along the thermal spray coating 26 in any desirable pattern. In the illustrated example, the laser remelted sections 28 are separated by unmelted portions 32 that are unaffected and unmelted by a laser. In other words, each laser remelted section 28 is disposed adjacent to a portion 32 of the thermal spray coating 26 that remains unmelted by laser. Spot sizes of the laser remelted sections 28 could be much smaller than 1 mm, such as 50 μm, by way of example.

Figure 3B:
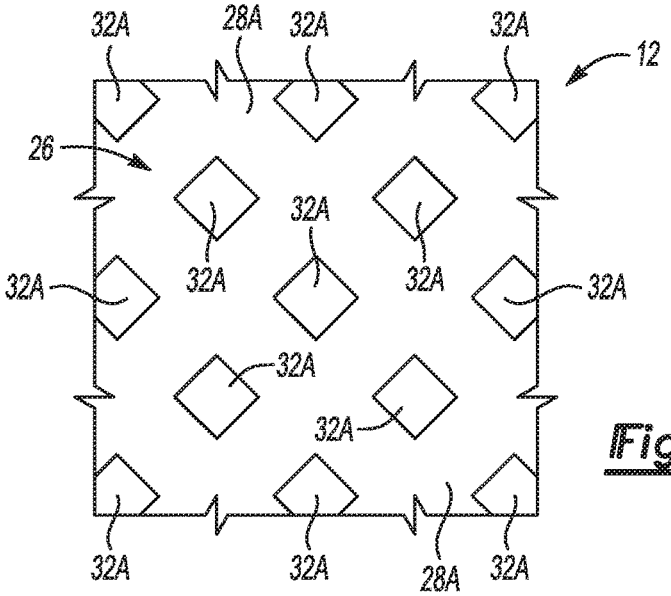
FIG. 3B is a side view from within one of the cylinder bores shown in FIG. 1, showing another variation of the cylinder bore wall substrate, in accordance with the principles of the present disclosure.

FIG. 3B shows another variation of the laser remelted sections 28A. The laser remelted sections 28A are illustrated as a lattice network of laser remelted sections 28A, which form a significant amount of anchoring to the substrate 19. The laser remelted sections 28A could be made with a plurality of lines formed by moving a laser beam along the thermal spray coating 26 in a criss-cross pattern, or in any other pattern to form a connected network of laser remelting 28A. In the illustrated example, the laser remelted lattice sections 28A are separated by unmelted portions 32A, forming diamond-shaped unmelted areas, that are unaffected and unmelted by a laser. The unmelted portions 32A could alternatively have any other shape, such as a circular shape.

In the example of FIGS. 2 and 3A-3B, each laser remelted section 28, 28A of the thermal spray coating 26 forms a diffusion bond 34 with the inner surface substrate 19. Each diffusion bond may have a depth t on the order of about 100 μm, by way of example. The laser remelted sections 28 may be formed, for example, using a laser beam resulting in the diffusion bond 34 having atom sharing on both sides between the thermal spray coating 26 and the inner surface substrate 19 of the cylinder bore 14. Laser remelting may result in minimal dilution, cracking, and heat affected zones at the bond area 34 between the thermal spray coating 26 and the inner surface substrate 19. The laser remelted sections 28 (or 28A) may add strength to the cylinder bore 14, for example, by causing an increased high temperature creep strength that resists deformation, increased tensile and yield strengths, increased stiffness due to higher modulus of elasticity, and less thermal expansion of the inner surface substrate 19 to control the cylinder bore 14 size and shape during operation.

The engine block 10, including the inner surface substrates 19 of the cylinder bores 14, may be formed of an aluminum alloy substantially comprised of aluminum, by way of example. The thermal spray coating 26 may be formed of a steel or steel alloy that is substantially comprised of steel, by way of example.

Figure 4:
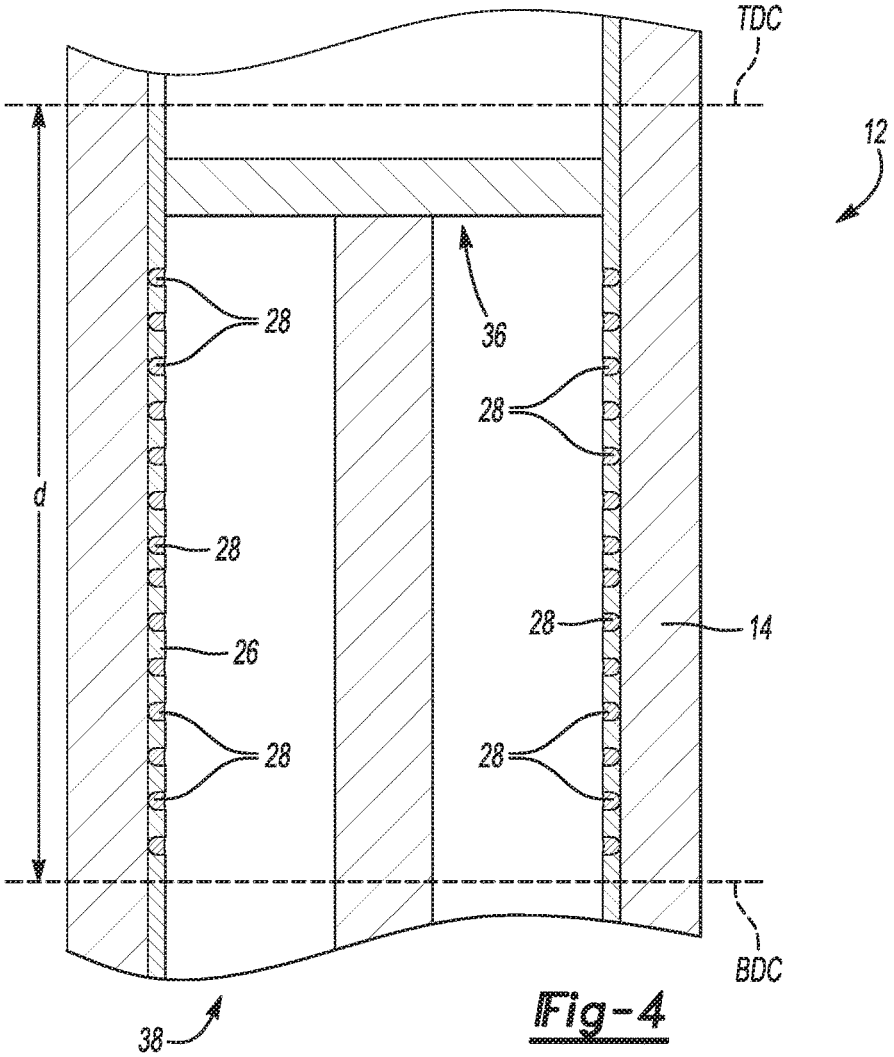
FIG. 4 is a cross-sectional view of one of the cylinder bores of FIG. 1, showing a piston disposed in the cylinder bore, according to the principles of the present disclosure.

Referring now to FIG. 4, each cylinder 12 has a piston 36 disposed therein that is configured to move within the cylinder 12 by virtue of the engine crankshaft (not shown). One engine combustion cycle of one cylinder 12 may include four strokes: an intake stroke, a compression stroke, an expansion stroke, and an exhaust stroke. During the intake stroke, the piston 36 is lowered to a bottom most position, and air and fuel may be provided to the cylinder 12. The bottom most position may be referred to as a bottom dead center (BDC) position, where the piston 36 is closest to the open end 38 of the cylinder 12. During the compression stroke, the crankshaft drives the piston 36 toward a top most position, thereby compressing the air/fuel mixture within the cylinder 12. The top most position may be referred to as a top dead center (TDC) position. During an engine combustion cycle, the piston 36 travels between BDC and TDC a length d along the inner surface substrate 19 of the cylinder bore 14 to define a piston travel path. Oil may lubricate the piston 36 along the piston travel path and past the oil pockets 30 formed by the laser remelted sections 28, as explained above. The substantial entirety of the piston travel path on each inner surface substrate 19 is covered by the thermal spray coating 26.

Figure 5:
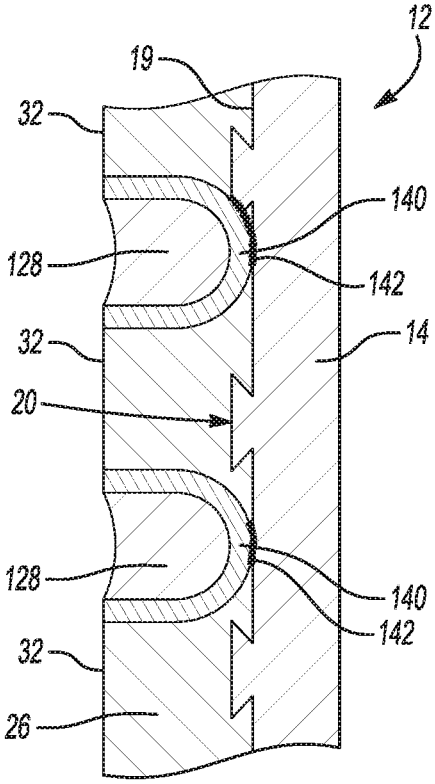
FIG. 5 is an enlarged schematic cross-sectional view of another variation of a portion of the cylinder bore wall substrate shown in FIG. 1, which could also be understood to be taken along line 2-2 of FIG. 1, according to the principles of the present disclosure.

Referring now to FIG. 5, another variation of the laser remelted sections is illustrated, and these laser remelted sections are generally designated at 128. The rest of the features, including the piston bore 14, the inner wall substrate 19, and the thermal spray coating 26 may be the same as already described above with respect to FIGS. 1-4. FIG. 5 is a cross-section of the cylinder 12, similar to that of FIG. 2.

A small heat affected zone (HAZ) 140 may surround each of the laser remelted sections 128. (The laser remelted sections 28 described above may also have small heat affected zones (HAZ), not shown). In this variation, though the laser remelted sections 128 themselves do not contact the inner surface substrate 19, the heat affected zones (HAZ) 140 may contact the inner surface substrate 19 to form bonds 142, such as atomic bonds, between the heat affected zones (HAZ) 140 and the inner surface substrate 19. Thus, the heat affected zones (HAZ) 140 anchor the thermal spray coating 26 to the inner surface substrate 19 of the cylinder bore 14 by forming the bonds 142 with the inner surface substrate 19.

The heat affected zones (HAZ) 140 may allow more of an atomic wetting between the thermal spray coating 26 and the aluminum substrate 19 (similar to brazing), and not a pronounced diffusion zone as in the laser remelting bond 34 illustrated in FIG. 2. For example, in FIG. 2, laser remelting causes an adhesion between the thermal spray coating 26 and the aluminum substrate 19 by diffusion bonding, where a new compound is formed or mixing occurs between the materials at the bonds 34. In the example of FIG. 5, the heat affected zone (HAZ) 140 from the laser only yields enough heat to a produce a wetting effect similar to brazing where an atomic bonding is achieved without a significant diffusion zone.

Referring now to FIG. 6, another variation of the cylinder 12 includes a cylinder bore 214 having an inner surface substrate 219 and thermal spray coating 226 with laser remelted sections 228. Any feature not described as being different may be similar to the features described above with respect to any of FIGS. 1-5. FIG. 6 is a cross-section of the cylinder 12, similar to that of FIGS. 2 and 5. The inner surface substrate 219 may have a surface profile 220 that is simpler than the dovetailed surface profile 20 shown above in FIGS. 2 and 5.

The cylinder 12 has an interface material 244 disposed between the inner surface substrate 219 of each cylinder bore 214 and the thermal spray coating 226. The interface material 244 is formed of a material that is different than the material used to form the substrate 219 and different from the material that is used to form the thermal spray coating 226.

The interface material 244 is used to enhance the bond 242 formed between the thermal spray coating 226 and the substrate 219, especially at the laser remelted sections 228. For example, the interface material 244 may facilitate a bond 242 by creating a fusion zone similar to a flux material used in soldering or brazing. To this end, the interface material 244 may be formed, for example, of a material that has a lower melting point than both of the materials used for the substrate 219 and the thermal spray coating 226. In some forms, the interface material 244 may be formed of a material substantially comprised of zinc, copper, nickel, tin, or combinations thereof. The interface material 244 may be applied aqueously, by dipping, by thermal spray, or in any other suitable way.

A heat affected zone (HAZ) 240 may be present around each of the laser remelted portions 228 and function similarly to the heat affected zone (HAZ) 140 described above. For example, the heat affected zone (HAZ) 240 may help form the bond 242 between the thermal spray coating 226 and the substrate 219, further with aid of the interface material 244.

Though the heat affected zones (HAZ) 140, 240 are shown only in FIGS. 5 and 6, it should be understood that small heat affected zones (HAZ) would also be present in the variation of FIG. 2, and such heat affected zones (HAZ) could also result in a bond being formed between the inner surface substrate 19 and the thermal spray coating 26 in FIG. 2.

Referring now to FIG. 7, a method of creating an engine cylinder bore of an automotive engine, such as the engine cylinder bores 14, 214 described above, is illustrated and generally designated at 300. The method 300 includes a step 302 of providing an inner bore substrate defining an inner surface of the engine cylinder bore, where the inner bore substrate is formed of a first material. For example, the cylinder bore 14, 214 may be provided having a substrate 19, 219 made of an aluminum alloy, as described above.

The method 300 further includes a step 304 of disposing a thermal spray coating 26, 226 onto the inner surface 19, 219 of the engine cylinder bore 14, 214 such that a substantial entirety of a piston travel path on the inner surface 19, 219 is covered by the thermal spray coating 26, 226. The thermal spray coating 26, 226 is formed of a second material that is different than the first material. For example, the thermal spray coating 26, 226 may be formed of a steel alloy, as explained above.

The method 300 next includes a step 306 of melting at least a portion of the thermal spray coating with a laser after performing the step 304 of disposing the thermal spray coating onto the inner surface of the engine cylinder bore. The step 306 may include melting multiple sections of the thermal spray coating to form a plurality of laser remelted sections 28, 128, 228, while allowing at least a portion of the thermal spray coating to remain unmelted by the laser.

The melting step 306 may result in forming a diffusion bond between the thermal spray coating and the inner bore substrate at each laser remelted section; or in another variation, the melting step 306 may result in forming a bond between a heat affected zone 140 of each laser remelted section 128 and the inner bore substrate 19.

In some variations, the method 300 may further include depositing an interface material, such as the interface material 244 shown in FIG. 6, onto the inner bore substrate 219 between the inner bore substrate 219 and the thermal spray coating 226. The interface material 244 would preferably be formed of a material different than the materials of both the inner bore substrate 219 and the thermal spray coating 226. For example, the third material could have a lower melting point than the material of the spray coating 226 and the substrate 219, and the third material could be substantially comprised of zinc, copper, nickel, or tin, or a combination thereof.

The method 300 may further include additional optional steps, such as activating the substrate 19, 219 to achieve better adhesion between the subsequently-applied thermal spray coating 26, 226 and the substrate 19, 219. For example, activation may include machining grooves into or removing material from the inner surface substrate 19, 219 using a tool to remove material, to create a base surface profile. The method 300 may optionally include washing of the cylinder bores 14, 214, for example, after machining the substrate 19, 219.

The method 300 may also include an optional step of performing a secondary roughening procedure, such as water jetting or another mechanical operation, to complete the surface profile 20, 220 along the length of the substrate 19, 219. It should be noted, however, that use of the laser remelting and/or the interface material 244 may relieve some of the necessity of such in-depth activation procedures, because the laser remelting and the interface material 244 provide for better anchoring of the thermal spray 26, 226 to the substrate 19, 219. Thus, in other variations, some or all of the surface activation procedures may be eliminated.

Use of the laser may create a plasma, vaporize some the materials, and/or create a new metallic mixture of the materials. Though performed at room temperature, the temperature at the actual point of laser melting/remelting could be, for example, 2000 degrees Celsius, or at any temperature higher than the melting points of the materials for the substrate and the thermal spray coating (e.g., aluminum and steel). Accordingly, the laser may cause intermetallic mixing at the localized bond 34 between the substrate 19 and the thermal spray coating 26, or at the bond 142, by way of example.

Various different kinds of laser beams could be used such as Gaussian laser beams, beams that are pulsed or continuous, and beams having any desired power or shape that is suitable to cause a bond without vaporizing the materials.

The description is merely exemplary in nature and variations are intended to be within the scope of this disclosure. The examples shown herein can be combined in various ways, without falling beyond the spirit and scope of the present disclosure. Such variations are not to be regarded as a departure from the spirit and scope of the present disclosure.

What is claimed is:

1. A method of creating an engine cylinder bore of an automotive engine, the method comprising:

providing an inner bore substrate defining an inner surface of the engine cylinder bore, the inner bore substrate being formed of a first material;

disposing a thermal spray coating onto the inner surface of the engine cylinder bore such that a substantial entirety of a piston travel path on the inner surface is covered by the thermal spray coating, the thermal spray coating being formed of a second material that is different than the first material; and melting multiple sections of the thermal spray coating with a laser after performing the step of disposing the thermal spray coating onto the inner surface of the engine cylinder bore to form a plurality of laser remelted sections, while allowing at least a portion of the thermal spray coating to remain unmelted by the laser, wherein the step of melting at least a portion of the thermal spray coating with the laser comprises forming an atomic bond between a heat affected zone (HAZ) of each laser remelted section and the inner bore substrate without melting the inner bore substrate.

2. A method of creating an engine cylinder bore of an automotive engine, the method comprising:

providing an inner bore substrate defining an inner surface of the engine cylinder bore, the inner bore substrate being formed of a first material;

depositing an interface material onto the inner bore substrate, the interface material being formed of a third material that is different than the first material;

disposing a thermal spray coating onto the interface material such that a substantial entirety of a piston travel path on the inner surface is covered by the thermal spray coating, the thermal spray coating being formed of a second material that is different than the first material and the third material; and melting at least a portion of the thermal spray coating with a laser after performing the step of disposing the thermal spray coating onto the interface material, wherein the third material has a lower melting point than each of the first and second materials.

3. The method of claim 2, the first material being at least substantially comprised of aluminum, the second material being at least substantially comprised of steel, and the third material being at least substantial comprised of at least one of the following: zinc, copper, nickel, and tin.

4. The method of claim 1, wherein the step of melting at least a portion of the thermal spray coating with the laser includes melting the thermal spray coating to form a connected network of laser remelted sections.

5. An engine block comprising:

a base block comprising a plurality of cylinders, each cylinder defining a cylinder bore having an inner surface;

an interface material disposed on the inner surface of each cylinder bore; and a steel thermal spray coating disposed on the interface material such that a substantial entirety of a piston travel path on each inner surface is covered by the thermal spray coating, the thermal spray coating having a plurality of laser remelted sections providing anchoring of the thermal spray coating to the inner surface of each cylinder bore, each of the interface material, the base block, and the steel thermal spray coating being formed of a different materials from one another, wherein each laser remelted section is disposed adjacent to a portion of the thermal spray coating that remains unmelted by laser, wherein each laser remelted section of the thermal spray coating is surrounded by a heat affected zone (HAZ) that forms an atomic bond with the inner surface of a cylinder bore of the plurality of cylinder bores.

6. The engine block of claim 5, wherein the interface material has a lower melting point than each of the base block and the steel thermal spray coating.

7. The engine block of claim 6, the base block being at least substantially comprised of aluminum and the interface material being at least substantial comprised of at least one of the following: zinc and tin.

* * * * *